US007134837B2

(12) United States Patent
Shaw

(10) Patent No.: US 7,134,837 B2
(45) Date of Patent: Nov. 14, 2006

(54) CAVITATION ALLEVIATION AND LINE CUTTING DEVICE

(76) Inventor: Robin David Shaw, 252 Hursley, Winchester, Hampshire, SO21 2JJ (GB)

( * ) Notice: Subject to any disclaimer, the term of this patent is extended or adjusted under 35 U.S.C. 154(b) by 99 days.

(21) Appl. No.: 10/485,659

(22) PCT Filed: Aug. 6, 2002

(86) PCT No.: PCT/GB02/03613

§ 371 (c)(1),
(2), (4) Date: Aug. 20, 2004

(87) PCT Pub. No.: WO03/013954

PCT Pub. Date: Feb. 20, 2003

(65) Prior Publication Data

US 2004/0266281 A1 Dec. 30, 2004

Related U.S. Application Data

(60) Provisional application No. 60/344,227, filed on Dec. 26, 2001, provisional application No. 60/315,739, filed on Aug. 29, 2001.

(30) Foreign Application Priority Data

Aug. 8, 2001 (GB) ..... 0119332.5
Dec. 21, 2001 (GB) ..... 0130665.3

(51) Int. Cl.
*B63H 1/18* (2006.01)

(52) U.S. Cl. ..... 415/121.1; 416/247 A

(58) Field of Classification Search ..... 416/146 R, 416/93 A, 248, 247 A; 415/121.1, 183, 914
See application file for complete search history.

(56) References Cited

U.S. PATENT DOCUMENTS

| | | | | |
|---|---|---|---|---|
| 218,438 | A | 8/1879 | Heath | 416/236 |
| 4,676,758 | A | 6/1987 | Dennis | 416/146 |
| 4,938,724 | A | 7/1990 | Shaw | 416/146 |
| 5,192,191 | A * | 3/1993 | Tasaki | 416/90 A |

FOREIGN PATENT DOCUMENTS

| | | |
|---|---|---|
| FR | 2 507 562 | 12/1982 |
| GB | 2 110 307 | 6/1983 |
| GB | 2 139 169 | 11/1984 |
| GB | 2 204 549 | 11/1988 |

* cited by examiner

*Primary Examiner*—Edward K. Look
*Assistant Examiner*—Nathan Wiehe
(74) *Attorney, Agent, or Firm*—Alfred A. Fressola; Ware, Fressola, Van Der Sluys & Adolphson, LLP

(57) ABSTRACT

A line cutting device for use with a hydrodynamic propeller has a blade (5) fixed to a vessel having the propeller. Three rotating blades (22) extend from a hub fixed around the propeller's shaft. The fixed and rotating blades are arranged for line shearing action. Each of the rotating blades has four apertures (21) extending from front to back through the blade for passage of water therethrough towards a respective blade of the propeller. The apertures are arranged to alleviate cavitation on the propeller blades.

21 Claims, 4 Drawing Sheets

CAVITATION ALLEVIATION AND LINE CUTTING DEVICE

CROSS REFERENCE TO RELATED APPLICATIONS

This application is for entry into the U.S. national phase under §371 for International Application No. PCT/GB02/03613 having an international filing date of Aug. 6, 2002, and from which priority is claimed under all applicable sections of Title 35 of the United States Code including, but not limited to, Sections 120, 363 and 365(c), and which in turn claims priority under 35 USC §119 to U.S. Patent Application No. 60/344,227 filed Dec. 26, 2001; Great Britain Patent Application No. 0130665.3 filed Dec. 21, 2001; U.S. patent application No. 60/315,739 filed Aug. 29, 2001 and Great Britain Patent Application No. 0119332.5 filed on Aug. 8, 2001.

TECHNICAL FIELD

The present invention relates to a cavitation alleviation device and in particular though not exclusively a line cutting device incorporating means for alleviating cavitation.

BACKGROUND OF THE INVENTION

Ships and boats can be immobilised by ropes fouling their propellers. In my British patent No. 2,204,549, I have described a line cutter having:

a rotatable cutting blade assembly mountable for rotation with the propeller shaft and including at least one rotatable cutting blade extending generally radially of the propeller shaft and having a cutting edge provided between an axially directed face and a circumferentially directed face; and a stationary cutting blade assembly adapted to be restrained against rotation by cooperation with the shaft bearing and including a stationary cutting blade extending generally radially of the propeller shaft, having a cutting edge provided between an axially directed and a circumferentially directed face and arranged for cutting action of its cutting edge in conjunction with the cutting edge of the or each rotatable cutting blade on rotation of the propeller shaft with the axially directed faces passing opposite each other during such rotation;

wherein the cutting edge of the or each rotatable cutting blade and/or the cutting edge of the stationary cutting blade is/are provided with serrations, and the cutting edges are shaped for cutting action of radially inner ones of the serrations prior to such action of radially outer serrations on continued rotation of the propeller shaft.

Cavitation of propellers has been an acknowledged problem for many years. It occurs when the pressure on the forward face of the propeller blades drops below the vapour pressure at the ambient temperature for the occurrence of boiling of water in which the propeller is working. Vapour bubbles form in the water due to the pressure reduction. The pressure reduction is a transitory effect and the vapour bubbles implode, eroding the propeller. Propellers are designed to work close to the threshold of cavitation over their entire surface, which results in the maximum amount of thrust being developed by the propeller at its design speed. Rotational speeds have increased with high speed engines.

A line cutter disturbs the water flow to its propeller and reduces the water pressure locally. This aggravates cavitation of the propeller.

SUMMARY OF THE INVENTION

An initial object of my present invention was to provide an improved line cutter, which alleviates the aggravation of cavitation caused by its presence.

To this end, I experimented with apertures in rotating blades of a line cutter. I was to surprised to discover that not only does the provision of apertures improve the cavitation effects resulting from the presence of the propeller, but also it is possible to improve upon the cavitation in the absence of any line cutter as such, by utilising the hydrodynamic effect of parts of one.

Thus a further object of my invention has become provision of a more general cavitation alleviation device.

According to a first aspect of the invention, there is provided a device for alleviating the effects of cavitation on a hydrodynamic propeller, the device comprising:

a hub adapted to fit around a propeller shaft and a plurality of fingers extending radially from the hub, the fingers each having:

at least one aperture extending from front to back through the finger for passage of water therethough towards a respective blade of the propeller, the apertures being arranged to alleviate cavitation on the propeller blades.

Please note that the term "hydrodynamic" is used in contradistinction from "aerodynamic".

Whilst the hub carrying the fingers can be envisaged to be a front part of the hub of the propeller, normally, the hub will be separate from the propeller and incorporate means for its securement to the propeller shaft.

The fingers can have unidirectional apertures, where they are intended to be fitted to unidirectional propellers. However, where the propellers are twin, counter-rotating propellers, the fingers can each incorporate a pair of apertures, one being suitable for each direction of rotation. Further the apertures can be a series of drillings or respective slots.

Preferably, the apertures will be arranged to direct water to the root areas of the propeller blades. With the apertures being arranged along most of the radial extent of the fingers, the latter are conveniently an order of magnitude smaller in radial extent than the propeller blades. Further, where the hub of the fingers is integral with the hub of the propeller, the apertures will be arranged upstream of the leading edge region of the blades, bearing in mind the pitch angle of the root of the propeller blades. Where the hub is separate from the hub of the propeller, the angular position of fingers with respect to the propeller blades can be adjusted, but is again preferably upstream of the leading edge region of the blades.

In the preferred embodiment of the invention, the fingers are rotating blades of a line cutting device.

Thus in accordance with another aspect of the invention there is provided a line cutting device for use with a hydrodynamic propeller, the device comprising:

a blade fixable in use with respect to a vessel having the propeller and a plurality of rotating blades extending from a hub fixable around the propeller's shaft, the fixed and rotating blades being arrangeable for line shearing action, wherein the rotating blades each have:

at least one aperture extending from front to back through the blade for passage of water therethough towards a respective blade of the propeller, the apertures being arranged to alleviate cavitation on the propeller blades.

The aperture, or one series of them, in the rotating cutter blade is preferably angled with respect to the forward face of the blade, to direct water flowing through the blade towards the propeller blade in the region of its root.

The aperture(s) can be a single drilling, or a series of drillings or one or more slots. Since propellers are often provided in contra-rotating pairs, the apertures are preferably similarly handed. Surprisingly, I have found that paired apertures, i.e. one directed towards the propeller blade and the other away, can provide the beneficial effect of the invention.

Whilst, in one embodiment, the handed apertures can be arranged with the intersection of their axes or axial planes behind the apertured rotating blade, in the embodiment that I prefer, I arrange the intersection inside the front of the blade. It can be in front of the blade. In either embodiment, the apertures can intersect the front surface of the blade, in which case, one(s) of them will be approximately aligned with the direction of flow to the blade and will allow more flow to pass than the other(s) aligned transverse to the flow. In the preferred embodiment, an enlarged orifice is provided for the both handed apertures.

It should be noted that my present improvement is applicable not only to serrated cutting blade line cutters, as in my prior patent, but also straight bladed line cutters as in prior British patent 2,139,169.

BRIEF DESCRIPTION OF THE DRAWINGS

To help understanding of the invention, a specific embodiment thereof will now be described by way of example and with reference to the accompanying drawings, in which.

DETAILED DESCRIPTION

Figure 1:
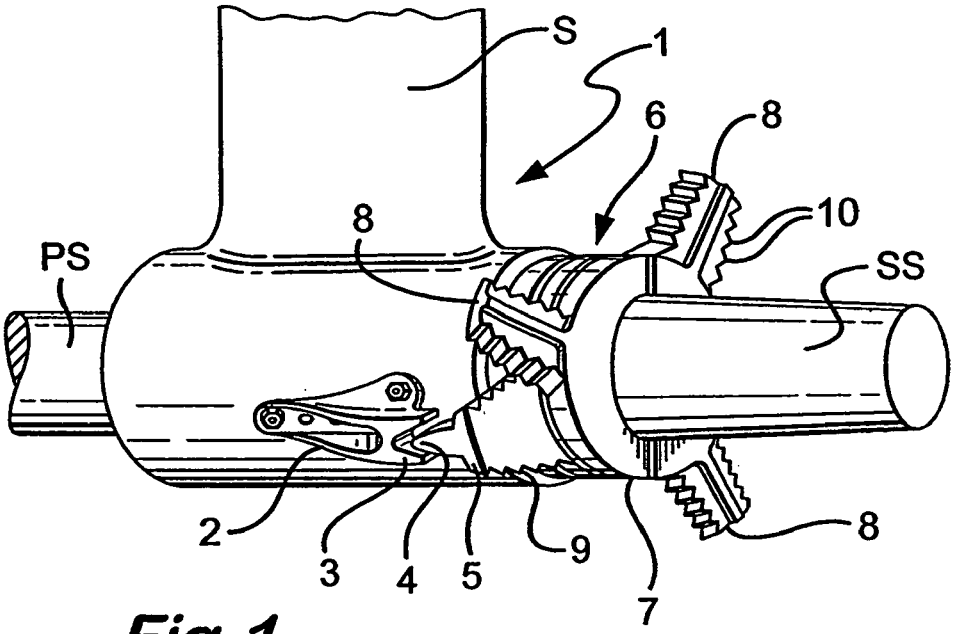
Fig. 1 PRIOR ART
FIG. 1 is a perspective view of a line cutting device in accordance with my prior patent.

Referring to FIG. 1, the line cutter 1 there shown is as described in my earlier British patent No. 2,204,549. A vessel's stem tube S journals a propeller shaft PS. A striker 2 is fixed to the stem tube and has a clevis 3 for receiving a lug 4 of a fixed blade 5. This is journalled in a synthetic material bearing 6 on a hub 7 from which three rotating blades 8 radiate. The fixed and the rotating blades have teeth 9,10, which engage and cut any rope becoming engaged in the cutter. A propeller (not shown in FIG. 1) is fixed to the stub SS of the shaft.

Figure 2:
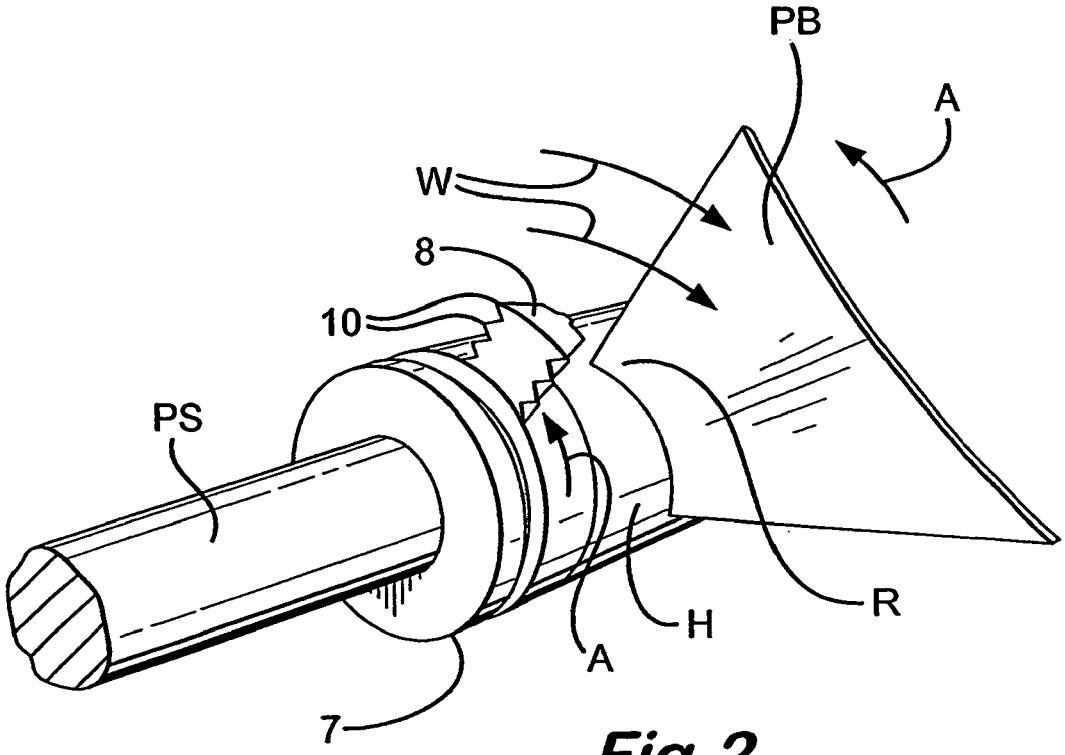
Fig. 2 PRIOR ART
FIG. 2 is a simplified sternwards perspective view of a single propeller blade and one rotating cutting blade of the prior device.
Figure 3:
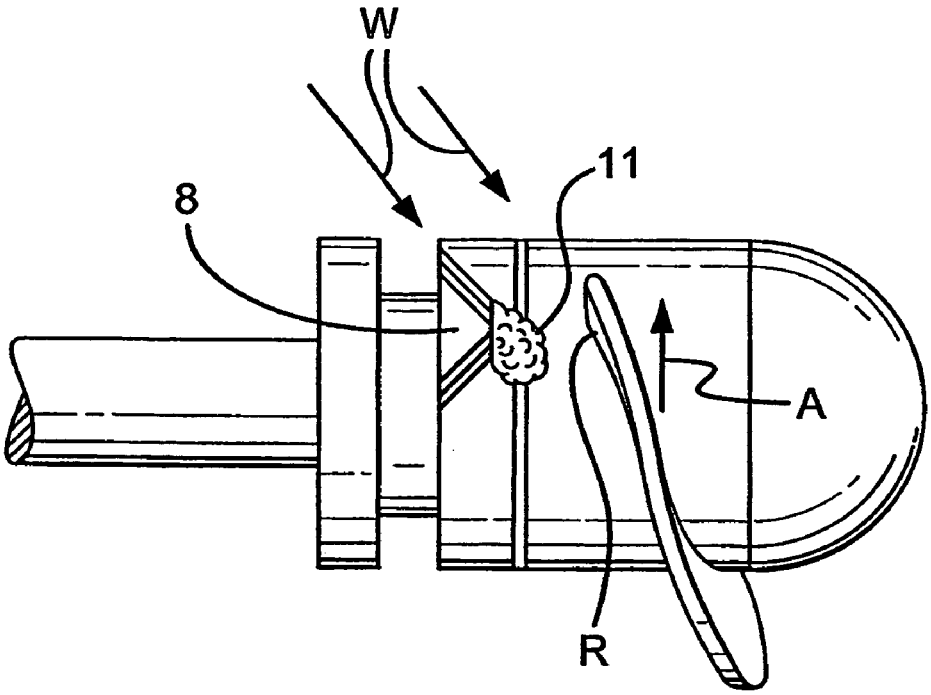
Fig.3 PRIOR ART
FIG. 3 is a plan view of the propeller blade and the cutting blade.

In FIG. 2, a single propeller blade PB is shown on a hub H fixed to the stub SS of the shaft, with the 7 of the line cutter 1 immediately in front of the propeller hub H. N.B. other parts, including other propeller blades, are omitted for clarity. The propeller blade PB and the rotating blade 8 rotate in the direction of arrows A. The relative water flow direction is in the direction W. Turning now to the plan veiw of FIG. 3, it can be seen that the rotating blade obstucts smooth flow to the propeller blade. A turbulent low pressure region 11 forms behind the rotating blade 8. This is conentrated in the root region R of the propeller blade PB, which is the region most susceptible to cavitation.

Figure 6:
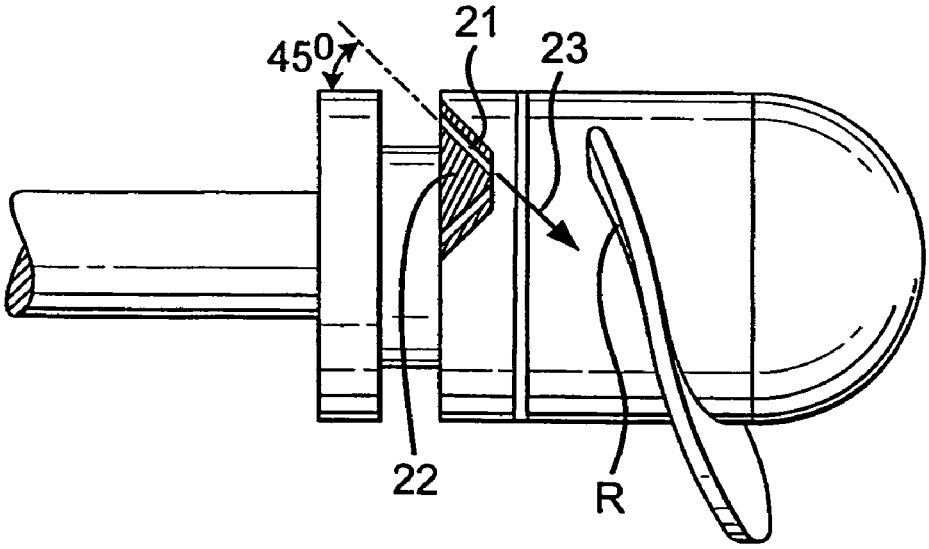
FIG. 6 is a view similar to FIG. 3 of the improved device.
Figure 4:
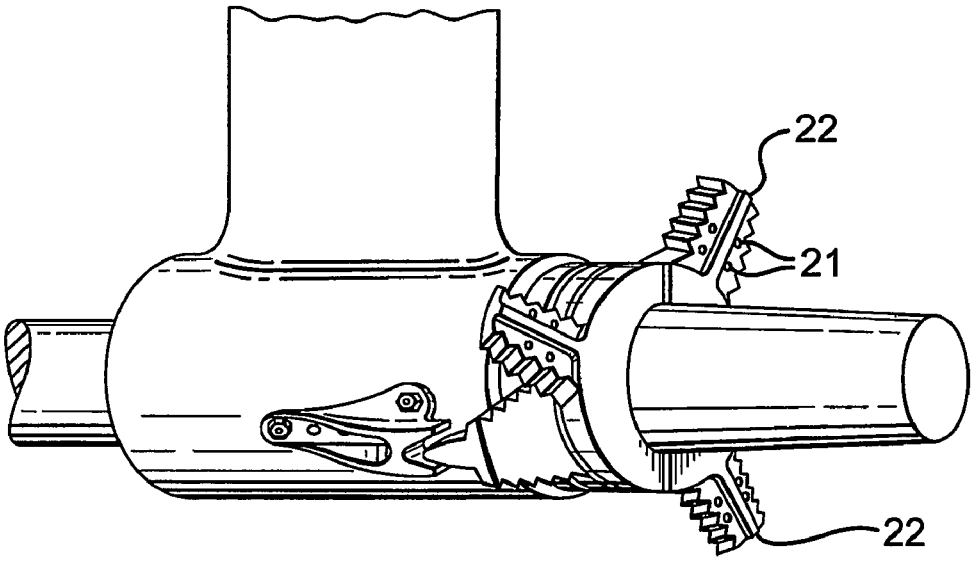
FIG. 4 is a view similar to FIG. 1 of a line cutting device improved in accordance with my present invention.
Figure 5:
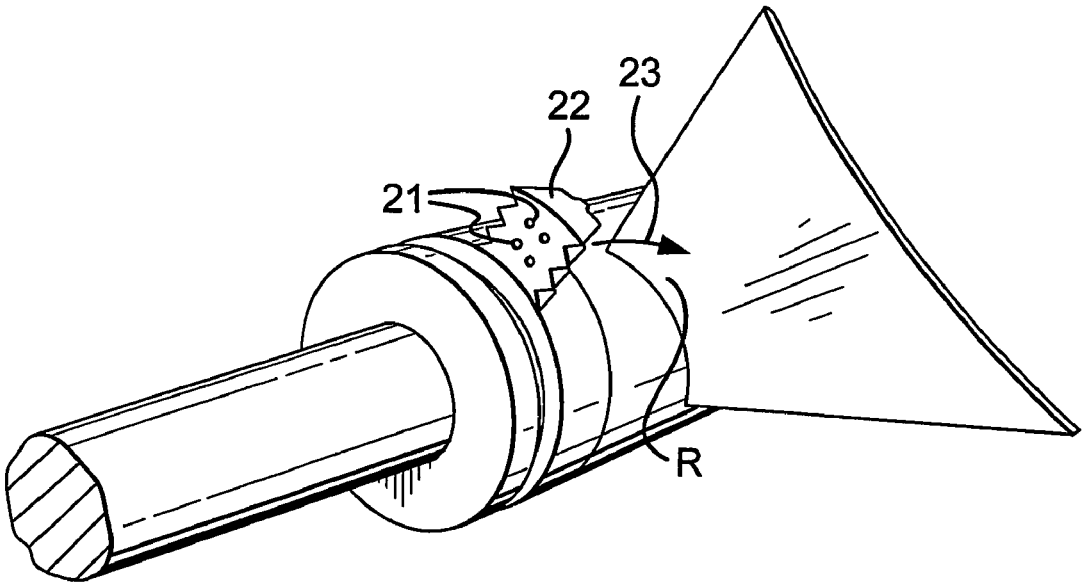
FIG. 5 is a view similar to FIG. 2 of the improved device.

The improvement of the invention is shown in FIGS. 4, 5 & 6, in that bores 21 are formed in the rotating cutter blades 22. These open on the upstream side of the blades in a high pressure region, due to the relative water velocity being slowed by impingement with the blade. The bores are angled at 45°, both towards and away from the direction of rotation A.

The effect of the presence of the bores is not fully understood. However, the practical result of them in a test environment is to improve the incidence of the cavitation on the propeller blade PB. Nevertheless, it is clear that water will flow through the bores and in particular through the ones substantially aligned with the flow. This flow 23 is directed towards the propeller blade. Tests have shown that it is preferable to direct this close behind the leading edge of the propeller blade into the root region R.

Figure 7:
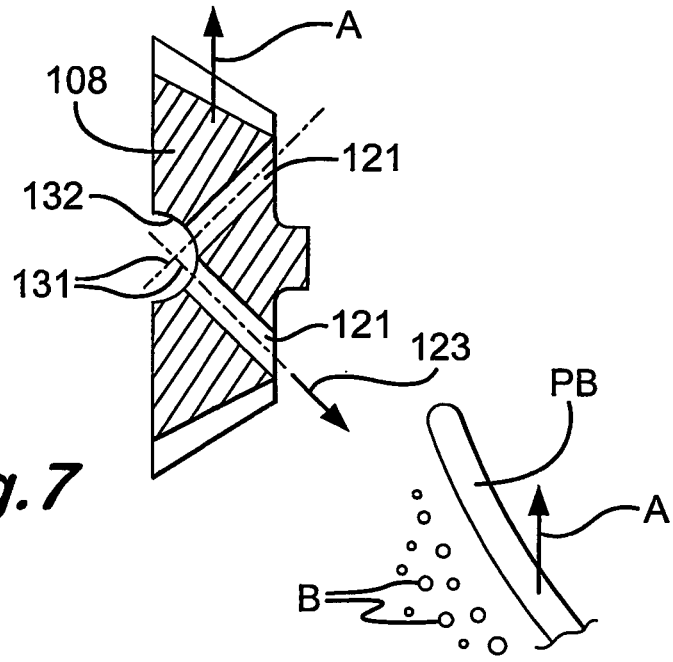
FIG. 7 is a view similar to FIG. 6, but on a larger scale, of the preferred arrangement of apertures in another improved device.

In the preferred variant shown in FIG. 7, the radially inner and outer bores facing respective directions each blade 108 are joined to form slots 121. The slots are aligned substantially radially in the blades and are positioned so that their axial planes 131 intersect within the blades. An enlarged orifice 132 is provided at their intersection. I believe that this acts as a scoop to enhance flow 123 to the propeller along the slot directed towards it.

In FIG. 7 is shown the effect that I have observed in a flow tank under stroboscopic illumination of cavitation bubbles B apparently lifted from the surface of the propeller blade PB by the flow 123 through the blade.

Figure 8:
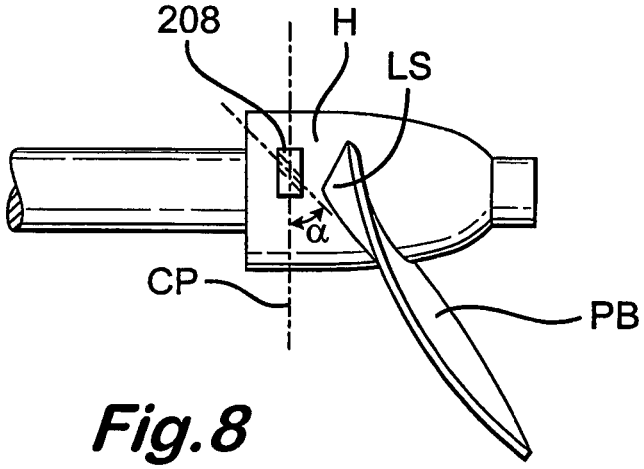
FIG. 8 is a view similar to FIG. 3 showing a simple cavitation alleviation device of the invention.
Figure 9:
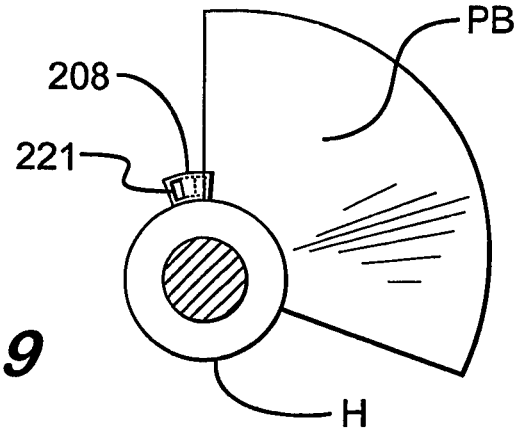
FIG. 9 is a front end view of the propeller blade and cavitation alleviation finger shown in FIG. 8.

In FIGS. 8 & 9 is shown an embodiment providing cavitation alleviation, without line cutting. Such an embodiment is envisaged to be useful for larger ships, where the engines are sufficiently powerful not to be troubled by lines fouling the propellers, but which run close to cavitation thresholds, whereby alleviation of cavitation is useful.

Radiating from a common hub H, are both propeller blades PB and cavitation alleviation fingers 208—one of each only being shown. These are positioned upstream of the propeller blades, so that the root of the blades, close to their leading edges is in their shadow, with respect to the direction of water flow when the propeller is being driven with full power. They have slots 221, oblique a to their common central plane CP, which are substantially aligned with this water flow direction. Thus water flowing through the slots is directed towards the root of the blades close to their leading edge, where it discourages cavitation at this cavitation prone area. To a first approximation, the water flow is parallel to the local shape LS of the propeller blades.

The invention claimed is:

1. A device for alleviating the effects of cavitation on a hydrodynamic propeller, the device comprising:

a hub adapted to fit around a propeller shaft and a plurality of fingers extending radially from the hub, the fingers each having:

at least one aperture extending from front to back through the finger for passage of water therethrough towards a respective blade of the propeller, the apertures being arranged to alleviate cavitation on the propeller blades, wherein the fingers are configured to form rotating blades of a line cutting device.

2. A device according to claim 1, wherein the hub carrying the fingers is a front part of the hub of a propeller.

3. A device according to claim 1, wherein the hub is separate from a propeller and incorporates means for its securement to the propeller shaft.

4. A device according to claim 1, wherein the apertures are slots in the fingers.

5. A device according to claim 1, wherein the apertures are a respective series of drillings in each finger.

6. A device according to claim 1, wherein the apertures are unidirectional, where the device is intended to work with a unidirectional propeller.

7. A device according to claim 1, wherein the apertures are arranged to direct water to root areas of the propeller blades.

8. A device according to claim 1, wherein the apertures are arranged to direct water close behind a leading edge of the propeller blades.

9. A device according to claim 1, wherein the apertures are arranged along most of the radial extent of the fingers.

10. A device according to claim 9, wherein the fingers are an order of magnitude smaller in radial extent than blades of a propeller.

11. A device according to claim 1, wherein the rotating blades are serrated.

12. A device according to claim 1, wherein the rotating blades are straight edged.

13. A device for alleviating the effects of cavitation on a hydrodynamic propeller, the device comprising:

a hub adapted to fit around a propeller shaft and a plurality of fingers extending radially from the hub, the fingers each having:

at least one aperture extending from front to back through the finger for passage of water therethrough towards a respective blade of the propeller, the apertures being arranged to alleviate cavitation on the propeller blades, wherein the apertures are paired, one aperture or one series of apertures being suitable for one direction of rotation and the other aperture or the other series of apertures being suitable for the other direction of rotation, the device being intended to work with one of a pair of counter-rotating propellers.

14. A device according to claim 13, wherein the paired apertures have axes or axial planes intersecting behind the respective fingers.

15. A device according to claim 13, wherein the paired apertures have axes or axial planes intersecting in front of the respective fingers.

16. A device according to claim 15, including an enlarged orifice in the front face of each finger from which the paired apertures diverge backwards.

17. A device according to claim 13, wherein the paired apertures have axes or axial planes intersecting inside the front of the respective fingers.

18. A device according to claim 17, including an enlarged orifice in the front face of each finger from which the paired apertures diverge backwards.

19. A line cutting device for use with a hydrodynamic propeller, the device comprising:

a blade fixable in use with respect to a vessel having the propeller and a plurality of rotating blades extending from a hub fixable around the propeller's shaft, the fixed and rotating blades being arrangeable for line shearing action, wherein the rotating blades each have:

at least one aperture extending from front to back through the blade for passage of water therethrough towards a respective blade of the propeller, the apertures being arranged to alleviate cavitation on the propeller blades.

20. A device according to claim 19, wherein the rotating blades are serrated.

21. A device according to claim 19, wherein the rotating blades are straight edged.

* * * * *

UNITED STATES PATENT AND TRADEMARK OFFICE

CERTIFICATE OF CORRECTION

PATENT NO. : 7,134,837 B2
APPLICATION NO. : 10/485659
DATED : November 14, 2006
INVENTOR(S) : Shaw It is certified that error appears in the above-identified patent and that said Letters Patent is hereby corrected as shown below:

At column 3, line 55, please delete the word "stem" and replace with --stern--.

At column 3, line 56, please delete the word "stem" and replace with --stern--.

Signed and Sealed this

Third Day of April, 2007

JON W. DUDAS
*Director of the United States Patent and Trademark Office*